United States Patent [19]

Dera et al.

[11] 4,101,983

[45] Jul. 25, 1978

[54] ENVELOPING HELMET OF COMPOSITE STRUCTURE

[75] Inventors: Alain Dera, Rueil-Malmaison; Marcel Goupy, Saint Cloud, both of France

[73] Assignee: Regie Nationale des Usines Renault, Boulogne-Billancourt, France

[21] Appl. No.: 803,268

[22] Filed: Jun. 3, 1977

[30] Foreign Application Priority Data

| | | | |
|---|---|---|---|
| Jun. 4, 1976 | [FR] | France | 76 17029 |
| Jan. 19, 1977 | [FR] | France | 77 01392 |
| Jan. 26, 1977 | [FR] | France | 77 02100 |

[51] Int. Cl.[2] ..... A42B 3/02

[52] U.S. Cl. ..... 2/412; 2/414; 2/425

[58] Field of Search ..... 2/414, 412, 425, 410, 2/411, 422, 423, 424, 6

[56] References Cited

U.S. PATENT DOCUMENTS

| | | | |
|---|---|---|---|
| 2,793,366 | 5/1957 | Kleinman | 2/411 |
| 3,116,490 | 1/1964 | Zbikowski | 2/414 |
| 3,245,087 | 4/1966 | Marchello | 2/422 |
| 3,911,496 | 10/1975 | Arai et al. | 2/423 |
| 3,992,721 | 11/1976 | Morton | 2/414 |
| 4,024,587 | 5/1977 | Barford | 2/424 |

FOREIGN PATENT DOCUMENTS

| | | | |
|---|---|---|---|
| 2,261,718 | 9/1975 | France | 2/414 |
| 801,321 | 10/1958 | United Kingdom | 2/414 |

*Primary Examiner*—Alfred R. Guest
*Attorney, Agent, or Firm*—Oblon, Fisher, Spivak, McClelland & Maier

[57] ABSTRACT

A protective helmet for use particularly by the rider of a two-wheeled vehicle, having an upper rigid shell joined to a semi-rigid shell of plastic material, the latter having extensions over the regions of a wearer's ears. An interior shock absorbing element is composed of two parts, the upper part extending frontwardly and rearwardly as far as the lower part, which is ring-like in form and extends around the entire lower interior part of the head, to provide protection in the rear.

12 Claims, 16 Drawing Figures

ENVELOPING HELMET OF COMPOSITE STRUCTURE

BACKGROUND OF THE INVENTION

1. Field of the Invention

The present invention relates to protective helmets intended particularly for use by riders of two-wheeled vehicles.

2. Description of the Prior Art

Helmets now on the market generally consist of a rigid shell, an inner lining and a shock-absorbing structure therebetween.

One can classify current helmets into three categories, namely the "bowl" helmets of hemispherical shape in which the surface of the shell stops at about the base of the skull, the "wrap-around" helmets with a shell covering the ears, and the "integral" helmets having, in addition, an extension passing around the chin.

The bowl helmets do not give sufficient protection. The wrap-around and integral helmets are more effective, but are not very practical. They are, in fact, generally difficult to put on and take off and sometimes they must be deformed by the exertion of a rather large force in order to do so. In order to make things easier, the makers provide a lot of room for the passage of the head. This is a dangerous solution to the problem since it increases the risk of having the helmet fly off in a collision. It is also uncomfortable because of the resultant play between the head and the lower part of the helmet and because of the relative motion of the helmet when one moves or turns his head, providing a feeling of looseness and partially masking the field of view.

To avoid this looseness and play, some manufacturers place inside the helmet and at the bottom thereof a band of rather thick sponge. To permit passage of the head, this sponge is usually very soft and does not contribute to the absorption of shocks (or very little), nor to resisting penetration by a blunt object if this part is outside the helmet shell.

SUMMARY OF THE INVENTION

Accordingly, it is an object of the present invention to provide an improved protective helmet which offers better protection to the wearer.

Another object of the present invention is to provide a protective helmet which has improved fitting to the wearer's head.

Still another object of the present invention is to provide a protective helmet which offers better protection, provides a better fit and is put on and taken off with greater ease than previous helmets of the same character.

The present invention offers a composite structure avoiding the foregoing drawbacks and permitting firm attachment of the helmet to the wearer's head, a good fit to differently shaped heads, and increased protection at the bottom.

BRIEF DESCRIPTION OF THE DRAWINGS

Other characteristics and advantages of the invention will be more fully appreciated as the same becomes better understood from the following detailed description, when considered in connection with the accompanying drawings in which.

DETAILED DESCRIPTION OF THE ILLUSTRATED EMBODIMENTS

Figure 1:
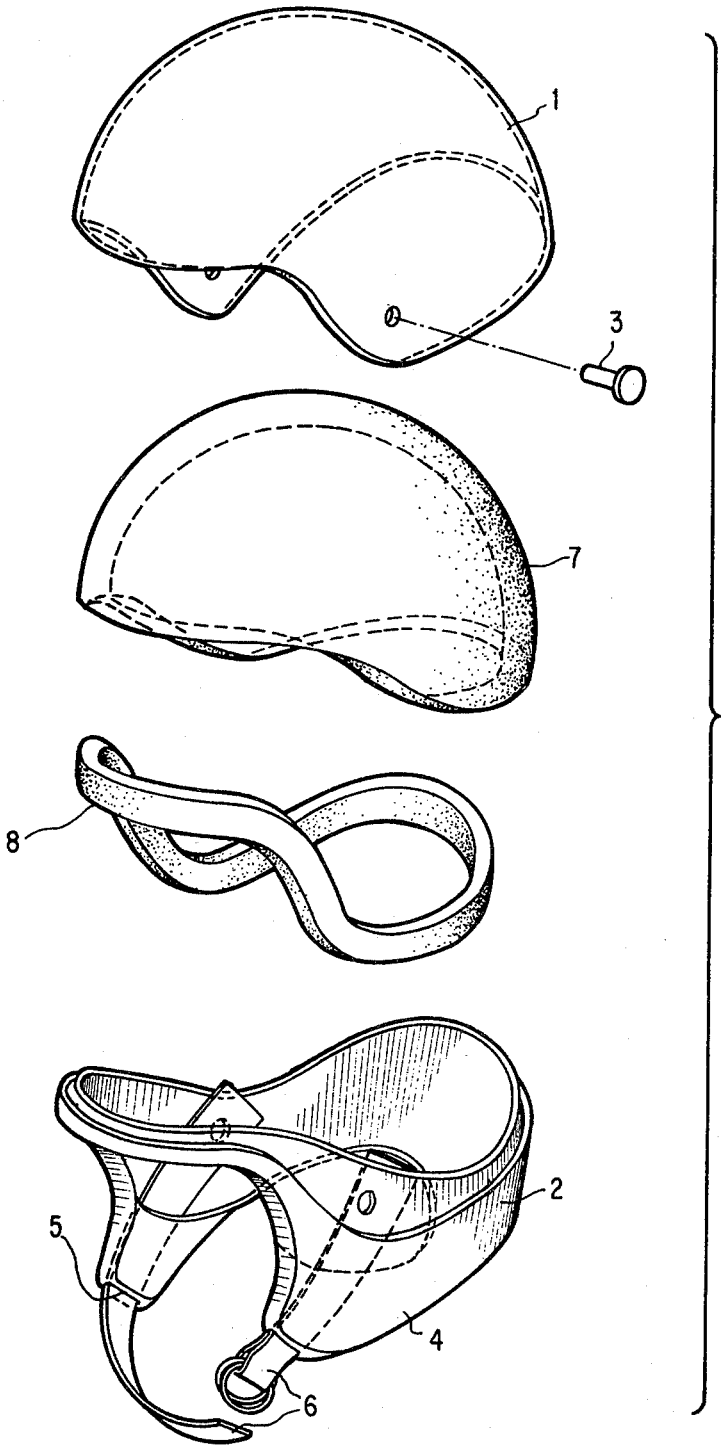
FIG. 1 is an exploded view of the different parts of the helmet.

Referring now to the drawings, the outside of the helmet of the present invention consists in its upper portion of a spherical shell 1 which is prolonged below by a wrap-around lower shell 2.

The shell 1 is of plastic and may be made by injection of polycarbonates or ABS or by compression molding of preinjected stratified polyesters; its thickness is of the order of 2.5 to 4.5 mm.

The lower shell is made of a semi-rigid material, for example of plasticized PVC or of thermoplastic polyurethane by injection molding, and can be thicker than the shell 1. It is attached to the latter by gluing and/or by means of rivets 3 or snaps and extends at the sides 4 so as to cover the ears of the wearer, as well as a portion of the lower jaw.

These side projections 4 have passages 5 through their lower parts for receiving the straps 6, one end of each strap being fastened to the shell 1 by one of the rivets 3.

The shape, thickness and material chosen for making the shell 2 permit easy spreading of the projections 4 when the wearer's head passes through, as well as pulling them inwards when buckling the chin-strap. In this way, proper tightness and a good fit of the helmet to the head are obtained.

The internal fittings of the helmet are in two parts:

an upper shock absorber 7 preferably of polystyrene foam of density between 15 and 20 g/cm$^3$ or of semi-rigid polyurethane foam of density between 30 and 120 g/dm$^3$, the surface of which is very close to that of the shell 1 and the thickness about 30 mm; and a lower shock absorber 8 in the form of a ring, having a wavelike form, going around the entire lower interior part of the helmet. This ring 8 is made, for example, of a semi-rigid polyurethane sponge with good resistance to compression, but readily deformable as a whole due to its ring shape.

A facing 9 is glued to the ring 8 and extends up to the absorber 7, surrounding the entire head, except at the ears where cavities 10 are formed in the shock absorber 7 into which the facing 9 protrudes. The facing may consist of a layer of soft sponge on cloth backing.

For good hearing and ventilation, holes 11, formed during molding, are provided in the shell 2 at the locations of the ears, opening into spaces free of padding to allow some ventilation at the ears.

Figure 2:
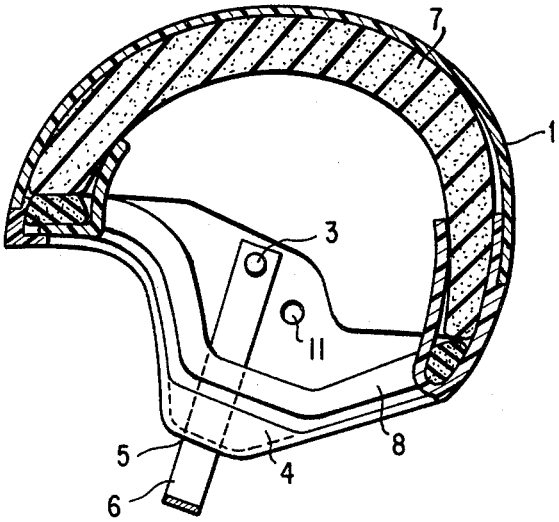
FIG. 2 shows a longitudinal cross section of the helmet shown in FIG. 1.
Figure 3:
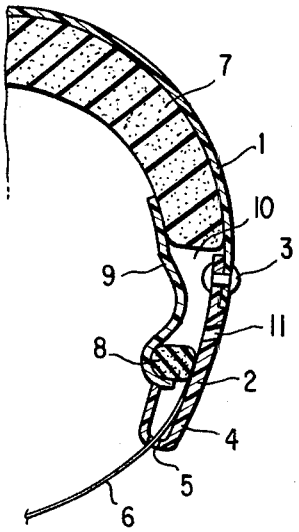
FIG. 3 is the vertical transverse half-section view of the helmet, taken approximately at right angles to the auditory passages.

As is seen in FIG. 2, the upper shock absorber 7 may extend frontward and rearward as far as the lower shock absorber 8 and penetrate into the interior of shell 2. This arrangement increases the protection in the rear, providing effective shock absorption in the direction of the helmet thickness.

The effect of some frontal fractures in rotating the head backwards, is to cause fatal fractures of the vertebrae. The extension of the upper shock absorber 7 to meet the absorber 8 reduces the chances of this occurring.

In addition, one can provide such things as holes in the lower shell 2 for attachment of certain types of safety buckles for the chin-strap, or even a rigid frontal piece joined to the shell 1 transforming the helmet into an "integral" one with its visor.

Figure 4:
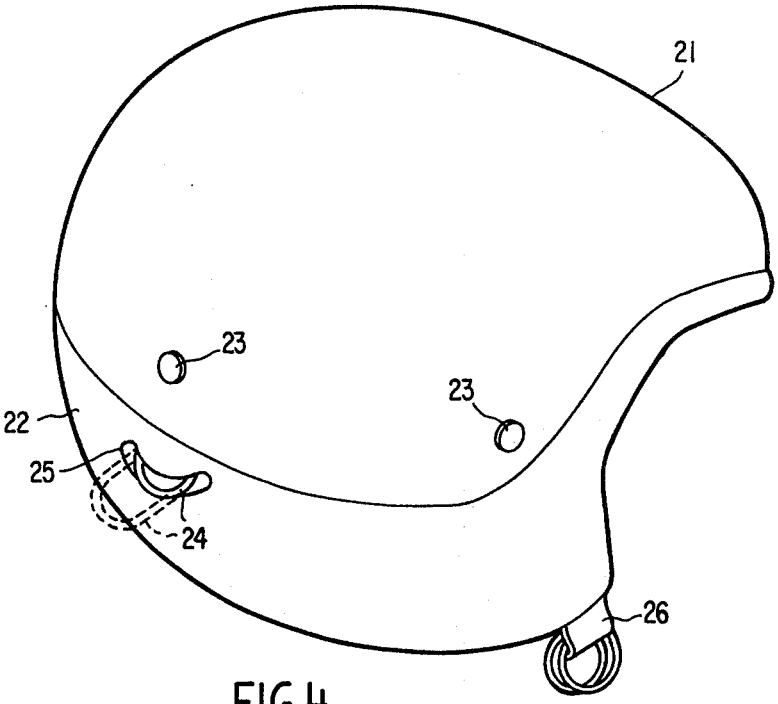
FIG. 4 shows a perspective view of the helmet.
Figure 5:
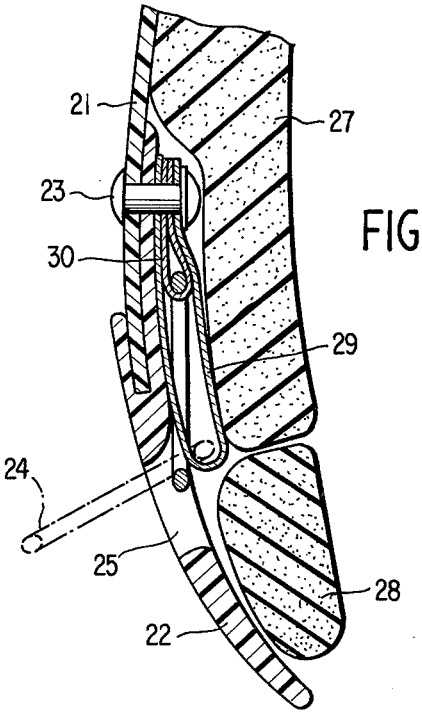
FIG. 5 is a cross section in a vertical plane passing through the middle of the ring.

The helmet shown in FIGS. 4 and 5 is a modification of that described above. It consists essentially of the same elements, and thus again the outer shell 21 and the lower wrap-around shell 22 attached thereto by means of rivets 23 are provided, as are the upper internal absorber 27, the lower internal absorber 28 and the means 26 for holding the helmet on the head.

The originality of the helmet of the present invention lies in the presence of a rigid ring 24, retractable through an opening 25 provided in the lower shell 22.

As shown in FIG. 2, the ring 24 slides inside a loop 29 riveted to the shell by a means 23, already described, from its upper retracted position indicated by solid lines to its lower partially protruding position shown by dashed lines. The loop is covered by the internal absorber 27 of plastic of the polystyrene foam type so as not to hurt the wearer's head.

In addition, a retracting element in the form of an elastic band 30, for example, possibly located inside the loop and held by the rivet 23, keeps the ring 24 in the retracted position, under tension, particularly in order to prevent any annoying vibration.

It is seen that, in the position of rest, the ring 24 is completely inside the helmet, thus hiding any unesthetic or dangerous portion thereof. However, the size of the opening 25 is enough to permit grasping the ring 24, which is then pulled out against the tension of the elastic band 30 and attached to the vehicle by any convenient means.

The internal surface of the ring 24 is provided for in consequence of the preceding, its solidity, as well as that of the loop 29 and the rivet, being designed to resist any attempt to detachment. Naturally one will not go beyond the bounds of the present invention if the helmet to which it is applied undergoes modifications in detail, such as a change in the number and distribution of the composite protective elements of which it is constituted.

The following modifications are intended to improve the protection of the wearer's jaw by means of separate shock absorber material in this region which, in addition, helps to maintain the good optical properties of the visor.

Figure 6:
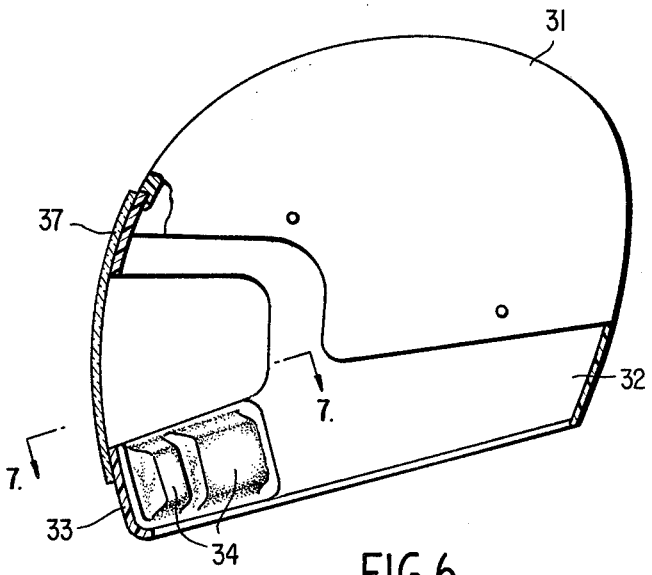
FIG. 6 is a helmet conforming to the invention, in a side view, with a partial section of the jaw portion.

It is seen in FIG. 6 that the lower shell 32 attached to the upper shell 31 by any satisfactory known means extends in a circular arc about the wearer's jaw by way of a portion 33 so as to protect this region in the manner of a so-called "integral" helmet.

Figure 7:
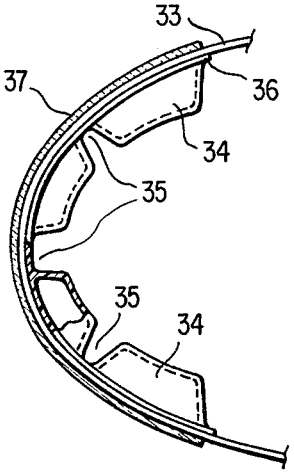
FIG. 7 is a section along a horizontal plane through the jaw portion.

The padding shown in FIGS. 6 and 7 can be obtained by injection molding or by thermo-forming a sheet of thermoplastic material, such as ABS, polyethylene or polypropylene, having a thickness of 0.5 to 2 mm, or any other similar compliant material.

In the case illustrated in FIGS. 6 and 7, the sheet is shaped so as to form several hollow compartments or cells 34, separated by ribs 35, their depth being of the order of 15 to 35 mm, to permit deformation with absorption of energy when the wearer's jaw is violently jammed thereagainst. Their height is about equal to that of the maxillary portion 33 of the lower shell, being in the neighborhood of 40 to 60 mm.

The piece 36, constituted by the compartments 34, is attached to the inner surface of the maxillary portion 33 of the helmet by any satisfactory means, such as force fit, riveting or gluing. Note that when the piece 36 is in place, the ribs 35 are vertical, permitting a circulation of air between the cells 34 and along the inner surface of the optional transparent screen 37 and thus sharply decreasing the amount of condensation due to the wearer's respiration.

Figure 8A:
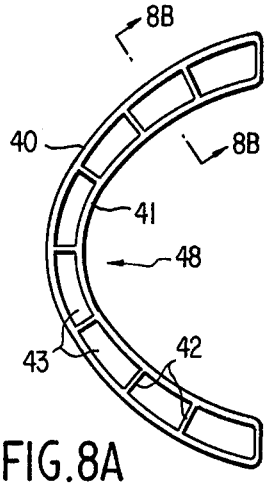
FIGS. 8A to 11C show modifications of the type of padding used.
Figure 8B:
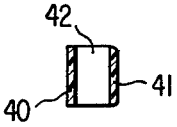

The embodiment shown in FIGS. 8A and 8B consists of a piece of padding 48 which can be made of the same synthetic thermoplastic materials mentioned in the preceding example, possibly formed by injection or extrusion and disposed in a manner analogous to the inner surface of the maxillary part of the helmet.

In the present instance it is seen that the piece 48 is formed by a partitioned volume made up of a front wall 40 and a rear wall 41, separated by the partitions 42 which thus define cells 43.

FIG. 8B, obtained by sectioning the piece 48 in a perpendicular transverse plane along the line 8B—8B in FIG. 8, shows the form of the cells and particularly their open upper and lower ends, permitting in this way the air circulation described above and preventing fogging of the screen 37.

Figure 9A:
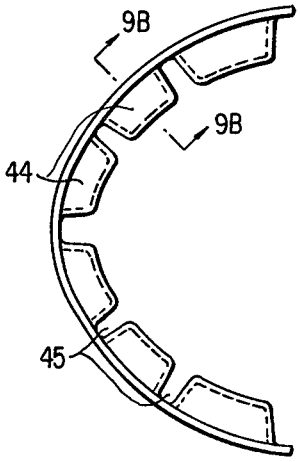
Figure 9B:
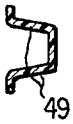

FIGS. 9A and 9B represent an embodiment very similar to that of FIGS. 6 and 7, showing that one can multiply the number of cells 34, which are closed at their upper and lower ends 49 (see FIG. 9B), which is a vertical section along the line 9B—9B, the ventilation being provided by way of the separating ribs 45.

Figure 10A:
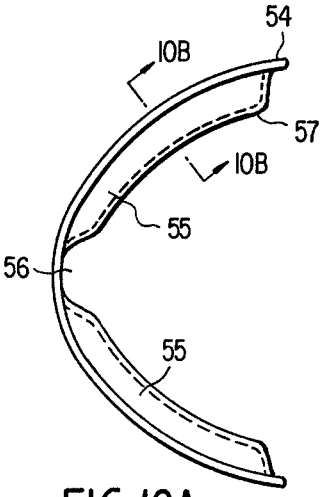
Figure 10B:
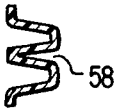

According to the representation in FIGS. 10A and 10B, an absorber element 54 is made up from a sheet of synthetic material comprising only a small number of cells 55, two being shown here, of larger volume, separated by a passage 56 for vertical circulation of the air.

As is seen in FIG. 10B, the vertical rear surface 57 of the absorber 54 has a horizontal median crease 58 extending into the internal surface of the maxillary part 33 of the shell, its purpose being to stiffen the element 54 and improve its capacity for absorbing energy.

Figure 11A:
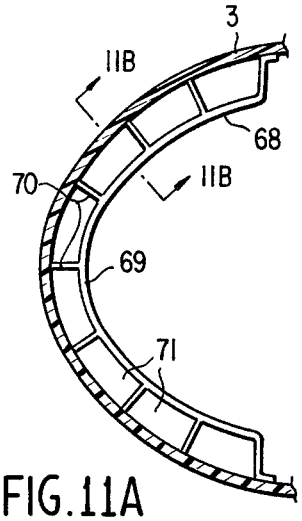
Figure 11B:
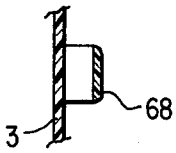
Figure 11C:
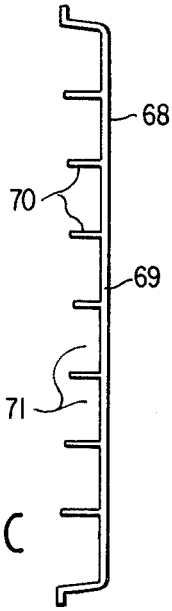

FIGS. 11A, 11B and 11C illustrate an arrangement similar to that illustrated in FIGS. 8A and 8B. The energy absorbing padding 68 herein is obtained by molding or extrusion of an element consisting of a strip 69 and ridges 70 perpendicular thereto which serve as partitions defining compartments 71, as is seen in FIG. 11C. This deformable padding, easy to strip from the mold, is then attached to the internal surface of the extrusion 3 of the helmet by any suitable means, e.g. gluing, clipping or riveting.

FIG. 11B, which is a section in a vertical plane along the line 11B—11B in FIG. 11, indicates that the compartments 71 are open above and below to permit ventilation of the screen 37. This unique padding 68 can, if necessary, be replaced by a group of several smaller padding elements, i.e., each comprising a smaller number of compartments 71.

The dimensions of the padding elements, as well as the synthetic thermoplastic materials used, are similar to those mentioned in the preceding examples.

Obviously many modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. A protective helmet, of composite structure, intended especially for riders of two-wheeled vehicles, the outer part thereof comprising an upper rigid shell obtained by injection of polycarbonates or ABS, or molding of stratified polyesters, and joined to a semi-rigid lower shell of plastic of the plastified PVC type or of injected thermoplastic polyurethane and having extensions over the regions of the ears, such being connected by gluing and/or riveting or clipping, and the interior shock absorbing part consisting of an upper rigid absorber of polystyrene foam of density between 15 and 20 g/dm$^3$ or a semi-rigid polyurethane foam of density between 30 and 120 g/dm$^3$, of hemispherical shape, and a lower absorber in the form of a semi-rigid sponge ring, e.g. of polyurethane foam.

2. A helmet as set forth in claim 1, further comprising a facing fabricated from a layer of soft sponge attached to a cloth backing being attached to said lower absorber by gluing, as well as to the bottom of the upper absorber.

3. A helmet as set forth in claim 2, wherein said extensions of the lower shell possess orifices in their lower portions, formed during molding, to permit passage of chin-strap sections.

4. A helmet as set forth in claim 2, wherein said upper and lower absorbers pass around the ears on each side, forming a cavity into which only the facing protrudes.

5. A helmet as set forth in claim 1, wherein said lower shell is provided, during molding, with orifices for heating and ventilation in the neighborhood of the auditory passage.

6. A helmet as set forth in claim 1, wherein said upper absorber extends into said lower shell, down to said lower absorber at the rear of the helmet.

7. A helmet as set forth in claim 1, wherein said lower shell has an opening through which a ring can be pulled from a retracted position to a partially exposed position, permitting passage of a means for attaching the helmet to the vehicle, the captive portion of the ring sliding between the shell and the inner, shock-absorber portion of the helmet inside a loop fastened to a rivet holding the upper and lower shells together, a retracting element, of elastomer for example, being provided to keep the ring under tension in the retracted position.

8. A helmet as set forth in claim 1, wherein said lower shell extends around the jaw of the wearer, forming a circular arc, the concave surface thereof being padded with an element of synthetic thermoplastic material, such as ABS, polyethylene or polypropylene, formed so as to create hollow cells separated by vertical partitions, the assembly constituting a shock absorber absorbing the incident energy during sharp contact between the wearer's jaw and the portion of the helmet next thereto.

9. A protective helmet as set forth in claim 8, wherein said cells constitute a closed volume and are separated from one another by vertical ribs permitting the circulation of air across a transparent screen forming the visor, so as to diminish or eliminate condensation.

10. A protective helmet as set forth in claim 8, wherein said cells are open at their upper and lower ends to permit circulation of air across a transparent screen forming the visor, and are separated from one another by solid vertical walls.

11. A protective helmet as set forth in claim 8, wherein the outer vertical face of the cells has a horizontal median crease for reinforcement, the groove in the wall reaching to the maxillary part of the helmet shell.

12. A protective helmet as set forth in claim 8, wherein the synthetic thermoplastic material constituting a shock absorber consists of at least one strip with ridges perpendicular thereto, the free ends of the ridges being joined to the inner surface of the helmet extension around the chin, notably by clipping, thus defining compartments of which the upper and lower faces are open.

* * * * *